US005197440A

United States Patent [19]

Georgs et al.

[11] Patent Number: 5,197,440

[45] Date of Patent: Mar. 30, 1993

[54] PRESSURE-CONTROLLED VALVE DEVICE FOR ENGINE RADIATOR

[75] Inventors: Georg Georgs, Stuttgart, Fed. Rep. of Germany; Peter Grasser, Graz, Austria

[73] Assignee: Mercedes-Benz AG, Fed. Rep. of Germany

[21] Appl. No.: 907,529

[22] Filed: Jul. 2, 1992

[30] Foreign Application Priority Data

Jul. 20, 1991 [DE] Fed. Rep. of Germany ..... 4124182

[51] Int. Cl.[5] ..... F07P 3/22

[52] U.S. Cl. ..... 123/41.54; 165/104.32

[58] Field of Search ..... 123/41.54; 165/104.32

[56] References Cited

U.S. PATENT DOCUMENTS 4,809,773 3/1989 Susa et al. ..... 123/41.54

FOREIGN PATENT DOCUMENTS 3439554 4/1986 Fed. Rep. of Germany .

3436702 9/1987 Fed. Rep. of Germany ..

1245326 9/1960 France ..... 123/41.54

*Primary Examiner*—Noah P. Kamen

*Attorney, Agent, or Firm*—Evenson, Wands, Edwards, Lenahan & McKeown

[57] ABSTRACT

A constructionally simpler and more reliable pressure-controlled valve device operates with opening pressure which can be switched to low pressure and high pressure on the cooling fluid circuit of an internal combustion engine, partricularly for a motor vehicle. The valve device can be subjected to gas or liquid from inside the cooling fluid container, depending on the operating condition of the engine, and a higher or lower opening pressure is effective depending on the type of pressure load. In such a device, two valves are functionally arranged within one unit such that they are located in parallel and open separately from one another for the different pressure ranges. For this purpose, the closing bodies of the low-pressure valve and of the high-pressure valve are located tightly one upon the other when the high-pressure valve is not open. When the high-pressure valve becomes effective, the flow outlet from the low pressure valve is shut off. It is shut off by a float raised by the cooling fluid.

4 Claims, 5 Drawing Sheets

PRESSURE-CONTROLLED VALVE DEVICE FOR ENGINE RADIATOR

BACKGROUND AND SUMMARY OF THE INVENTION

The present invention relates to a pressure-controlled valve device with an opening pressure which can be switched to low pressure and high pressure on the cooling fluid circuit of an internal combustion engine, particularly for a motor vehicle, and, more particularly, to a valve device is equipped with two spring-loaded moving closing bodies and is subjected from inside a cooling fluid container to pressure, depending on the operating condition of the engine, by gas emerging or vapor emerging from the cooling fluid (gas pressure load), on one hand, or by the cooling fluid itself (cooling fluid pressure load), on the other hand, and which opens at a higher pressure when subjected to fluid pressure than when subjected to gas pressure because of control by way of a float which can be raised with an increasing cooling fluid level.

A valve device is shown in DE 34 36 702 C2 which permits the cooling fluid circuit to be safeguarded with, on one hand, one operating pressure (low pressure) during the operation of the engine and, on the other hand, an increased pressure (high pressure) after the engine operation has been switched off. This prevents ejection of cooling fluid when the hot internal combustion engine has been switched off and the coolant circulation is interrupted. An increase in volume caused by the formation of an emergent such as vapor occurring locally does not then lead to an ejection of coolant. In the case of a cooling fluid volume increased beyond the engine operating condition, an additional pressure valve 'ocated in a float is connected upstream of the low-pressure valve adjusted to the operating pressure, with the two excess pressure valves being connected in series in this condition. Because of the series connection, the excess pressure valve in the float is only subjected to a relatively small closing force; this closing force corresponds to the difference between the opening pressure of the excess pressure valve located outside the float and that for the high pressure above atmosphere determined for the cooling fluid container when the engine is at rest. Should the high pressure in the cooling fluid container be, for example, 2 bar and the low pressure during engine operation be 1.4 bar, the closing pressure of the valve in the float is dimensioned at 0.6 bar. In the case of valves with a low closing pressure, high manufacturing accuracies are necessary for satisfactory operation, particularly with respect to the closing spring. In the known device, furthermore, two excess pressure valves are necessary with mutually independent structures and separate valve parts in each case, in particular separate closing springs. A similar device is shown in from DE 34 39 554 A1.

The present invention has an object of providing a simpler valve device which, with less manufacturing outlay, still operates reliably. In order to be able to reduce the manufacturing accuracy required for the springs and to be able to increase the functional reliability of the valve, one specific objective is to use few valve parts as possible and to have springs which do not have to be configured for a small pressure difference of the valve. In addition, the valve springs should, if possible, not be surrounded by the cooling fluid so that the springs are not subjected to the danger of sludging up and corrosion with the consequence of functional impairment.

The foregoing objectives have been achieved in accordance with the present invention by providing that the low-pressure closing body which determines the function when the device is subjected to gas is the support for the high-pressure closing body (16): when the float is raised, the flow path whose flow is controlled by the low-pressure closing body is shut off and a flow path leading through the low-pressure closing body to the high-pressure closing body is open; the closing pressure to which the closing bodies are subjected is introduced exclusively via the high-pressure closing body; the resultant effective area determining opening of the low-pressure closing body taking place under the control pressure is, under all operating conditions, greater than that for opening of the high-pressure closing body; and when the high-pressure closing body is open, the low-pressure closing body has a defined open position.

In a device constructed in such a way, the two valves controlling the high pressure and the low pressure are integrated into a common unit in which the closing force for both valves is applied by a common spring. Because the two valves act in a parallel connection in the arrangement according to the invention, the closing pressure of the spring corresponds to the total difference between the high pressure within the cooling fluid container and the atmosphere. The closing pressure which has to be applied by the common spring is, therefore, within a range for which small manufacturing inaccuracies in the production of the spring only affect the functional accuracy of the valves to an extremely small extent.

A particularly advantageous embodiment of the valve device according to the invention is one in which the low-pressure closing body has an annular peripheral sealing flange protruding radially outwards which can be seated so as to seal against the valve outlet flow direction on a valve seat permanently attached within the valve housing and which is connected radially outwards in a gas-tight manner to the valve housing by a sealing element substantially free of reaction forces. A low-pressure flow path emerging into the cooling fluid casing exists between the diaphragm and the sealing flange. The low-pressure flow path is tightly separated from the inside of the cooling fluid casing when the float is raised. The low-pressure closing body also has a high-pressure flow path connecting the cooling fluid container to atmosphere when the high-pressure closing body is open. Practically frictionless motion of the low-pressure closing body is possible by using a sealing diaphragm to form the two separated flow spaces within the closing body of the low-pressure valve.

A non-return valve opening in a corresponding manner can be introduced quite simply into the high-pressure closing body for pressure balance from the outside to the inside.

BRIEF DESCRIPTION OF THE DRAWINGS

These and further objects, features and advantages of the present invention will become more readily apparent from the following detailed description of a currently preferred embodiment when taken in conjunction with the accompanying drawings wherein.

DETAILED DESCRIPTION OF THE DRAWINGS

Figure 1:
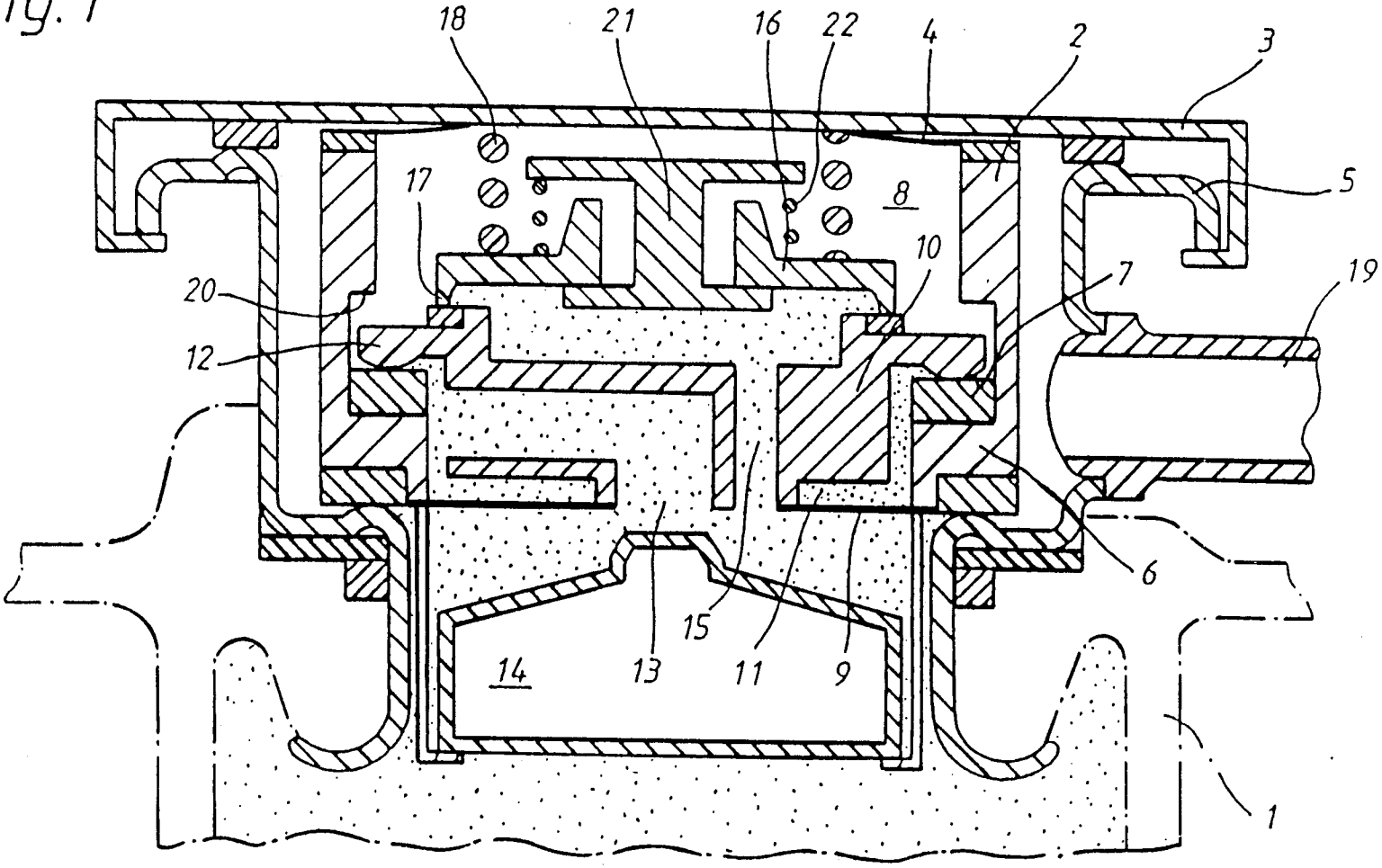
FIG. 1 is a longitudinal section view of a pressure-controlled valve device in which the condition of the valve device is shown when subjected exclusively to gas and with the high-pressure and low-pressure valve closing bodies closed.

A valve control device is installed in a geodetically upwards located opening of a cooling fluid container 1 of an internal combustion engine and exerts a smaller closing pressure in the case of a running internal combustion engine than it does in an engine-at-rest condition immediately after the engine has been stopped if, in this latter condition, the volume of the cooling fluid has for a short period increased beyond a certain amount due to local vapor bubbles occurring from overheating.

In general, the valve device consists of a support part 5 which is fixed in the opening of the cooling fluid container 1 and is covered towards the outside by a cap 3. A valve housing 2 is sealed in the support part 5 relative to the opening in the cooling fluid container 1, and is clamped against the cap 3 by a plate spring 4. This housing 2 has a valve seat 6 with a seal 7 seated on it. Whereas the valve housing 2 seals the internal space of the cooling fluid container 1 against atmosphere between the opening in the cooling fluid container I and the valve seat 6, the other region of this housing has penetrations 8 to atmosphere.

A low-pressure closing body 10 is tightly connected to the valve housing 5 by a diaphragm 9, and can be tightly placed on the valve seat 6 of the valve housing 2 by an integral sealing flange 12 formed radially outside. It is desirable for the diaphragm 9 to be free of reaction forces so that the closing of the overall device does not function incorrectly.

The closing body 10 is configured such that there is a low-pressure flow path 11 between the sealing flange 12, the diaphragm 9 and the valve housing 2. The path 11 is connected to the inside of the cooling fluid container I by an opening 13 which can be closed by a float 14 adapted to be raised by the cooling fluid.

In addition to the flow path 11, the low-pressure closing body 10 has a high-pressure flow path 15 leading to the inside of the fluid container 1. This high-pressure flow path 15 can be closed against atmosphere by a plate-shaped configuration of a high-pressure closing arrangement. In this closing arrangement, an annular protrusion 17 formed on the high-pressure closing body 16 is in sealing contact with the sealing flange 12 via a seal (unnumbered). The closing pressure for the two closing bodies 10 and 16 is introduced to the high-pressure closing body 16 by a compression spring 18 supported on the cap 3.

In the individual drawing figures, those spaces in the valve device which are filled with the gas or the cooling fluid itself originating from the cooling fluid are appropriately marked in each case. In the operating condition of FIG. 1, the high-pressure and low-pressure closing bodies 16 and 10, respectively, are each in the closed position.

The valve device can, for example, be configured such that the low-pressure closing body 10 opens at a gauge pressure of 1.4 bar and the high-pressure closing body 16 does not open until there is a gauge pressure of 2 bar. The float 14 ensures that a gauge pressure of 2 bar can only appear when the float is raised by the cooling fluid whereas, when the float is lowered, the internal pressure in the cooling fluid container cannot exceed a gauge pressure of 1.4 bar, which pressure is provided by the low-pressure closing body 10. The condition in which the float 14 is raised does not occur during normal driving operation of the engine but only appears for a short period after a hot engine has been switched off. In the condition just mentioned, the closing pressure of the valve device has to be raised in order to prevent ejection of cooling fluid.

Figure 2:
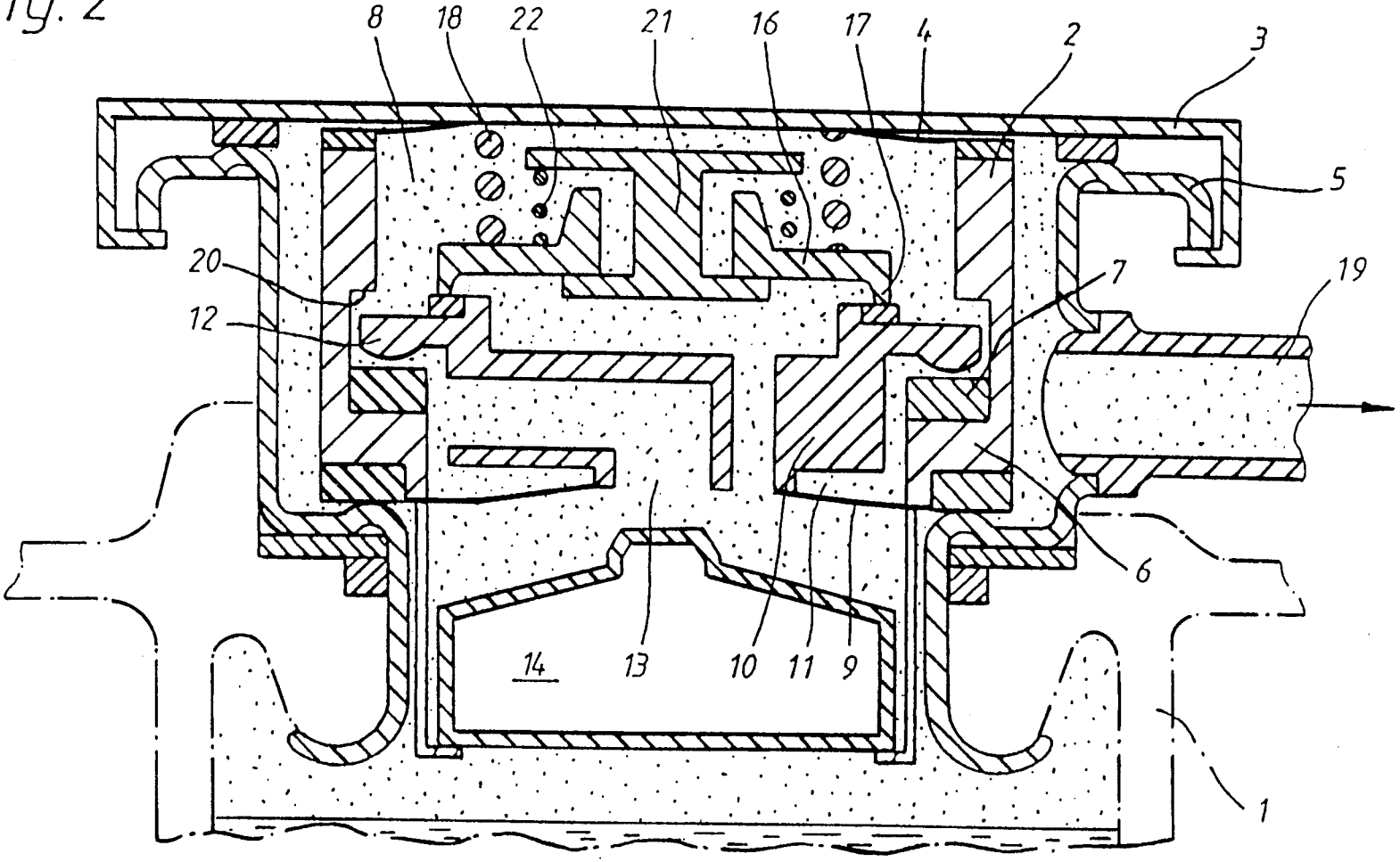
FIG. 2 is a view similar to FIG. 1 but showing the valve subjected to gas only, with the low-pressure closing body open and the high-pressure closing body closed.

This mode of operation of the valve device is achieved in accordance with the present invention, with the resulting pressure forces initiating an opening of the closing bodies 10, 16 by an appropriate configuring of the effective pressure areas of the two closing bodies 10, 16 such that when the float is not raised, the low-pressure closing body 10 opens first and, to be precise, on the attainment of the opening pressure set therefor. This condition is shown in FIG. 2 in which the sealing flange 12 of the low-pressure closing body 10 is raised from the seal 7 of the valve seat 6 of the valve housing 2. The float 14 keeps the access to the free space 11 inside the closing body 10 open so that the open position of the closing body 10 ensures free drainage of gas or cooling fluid into a valve outlet 19.

Figure 3:
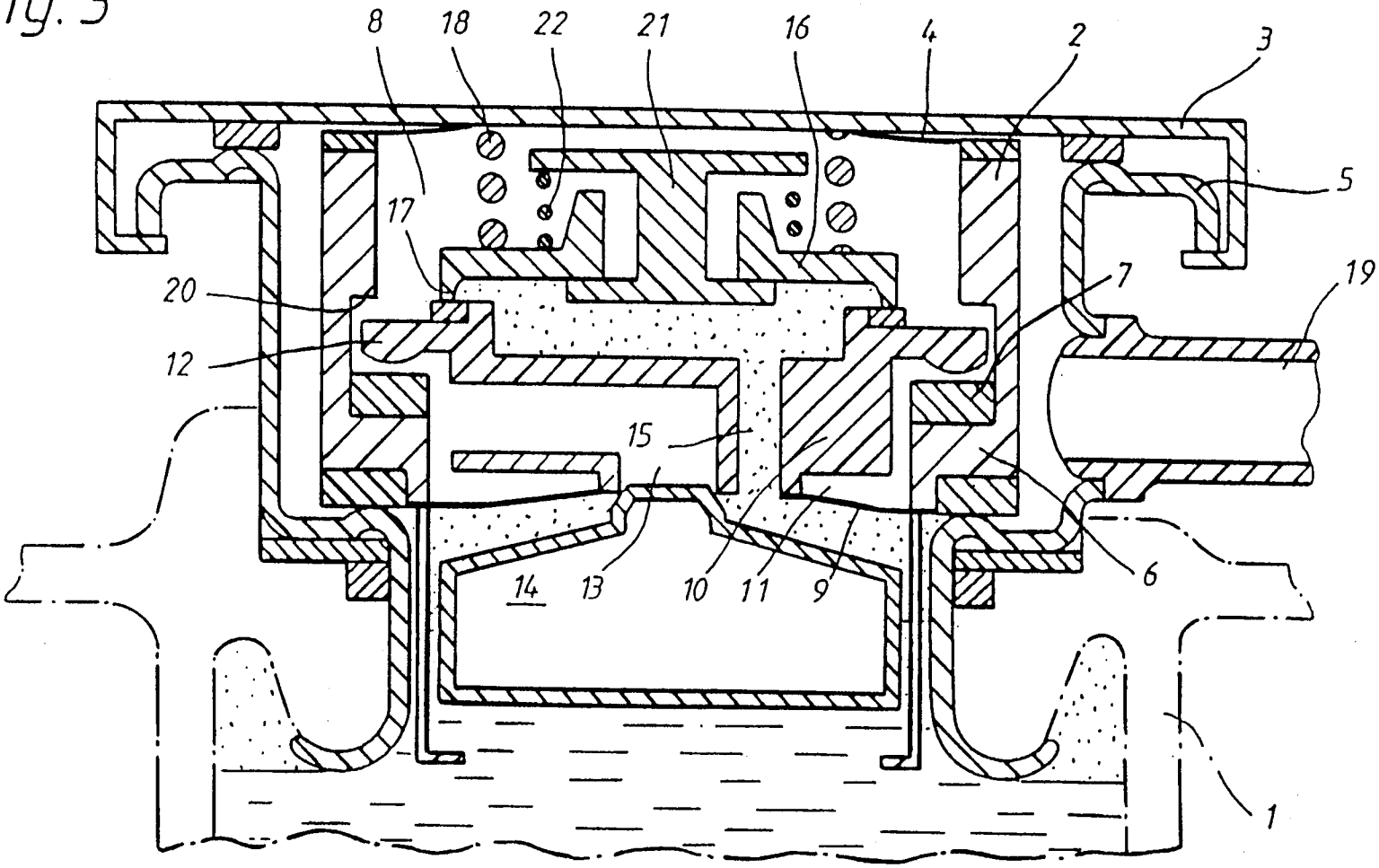
FIG. 3 is a view similar to FIG. i but showing the FIG. 3 shows a valve condition in which a flow passage through the low-pressure valve is interrupted by a float raised by expanded cooling fluid.

In the condition of the valve device of FIG. 3, the float 14 is raised and the opening 13 to the flow path 11 is closed. This state occurs after a hot engine has been switched off. The closing of the opening 13 has the effect that no further drainage flow can take place via the sealing flange 12 of the low-pressure closing body 10. The effective areas of the closing body 10 subjected to the internal pressure of the fluid container are designed in such a way that, before opening of the high-pressure closing body 16, the low-pressure closing body 10 first takes up a defined open end position by contact between its sealing flange 12 and a stop 20. In the operating condition of FIG. 4, the closing body 10 is on the way towards an end position at the stop 20, whereas this end position has been reached in the operating condition shown in FIG. 5. If the fluid container internal pressure exceeds the closing pressure set for the high-pressure closing body, the latter opens with the low-pressure closing body 10 in contact with the stop 20.

Figure 4:
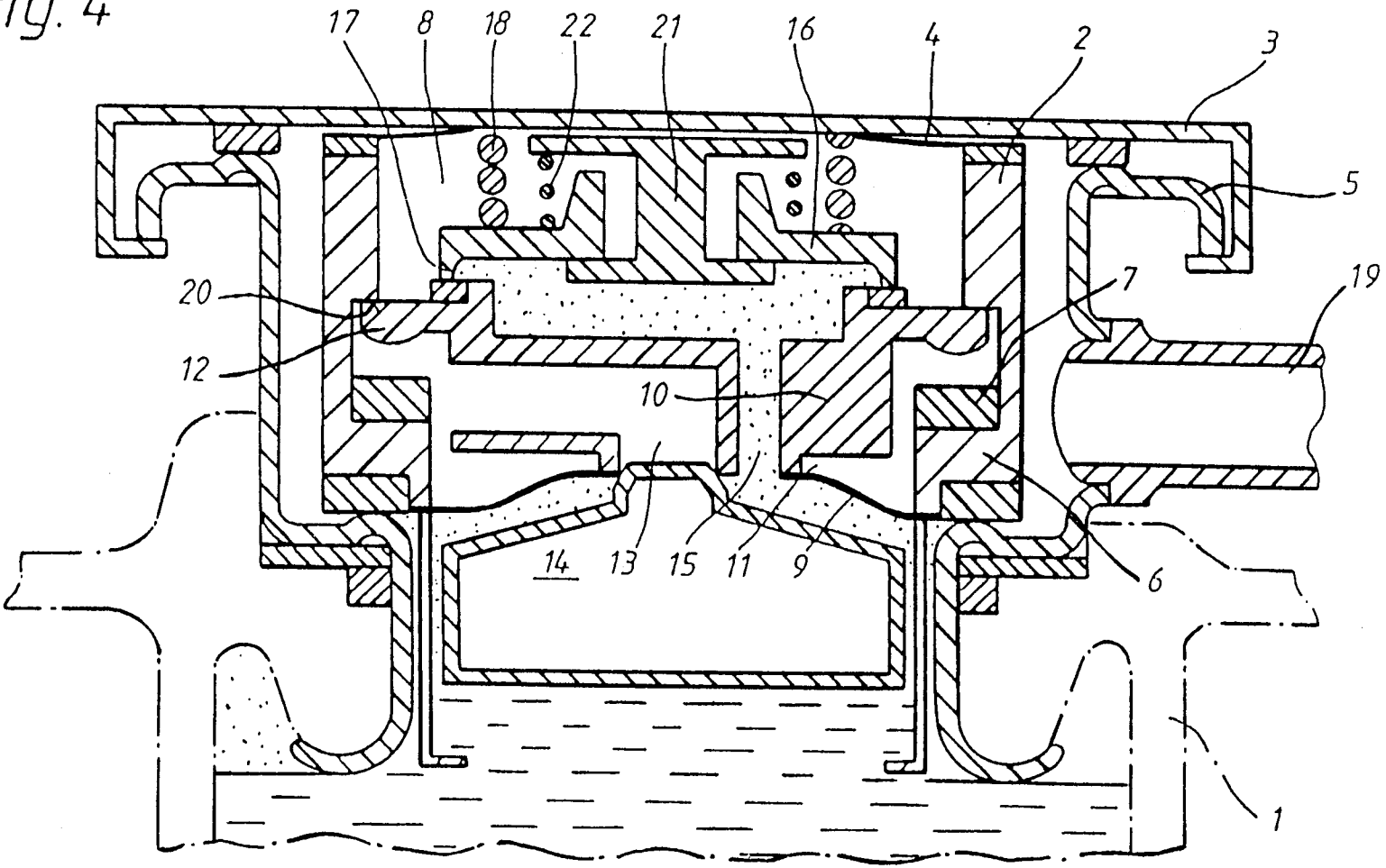
FIG. 4 is a view similar to FIG. 1 but showing the valve condition as shown in FIG. 3 but in which the low-pressure closing body takes up a defined open end position.
Figure 5:
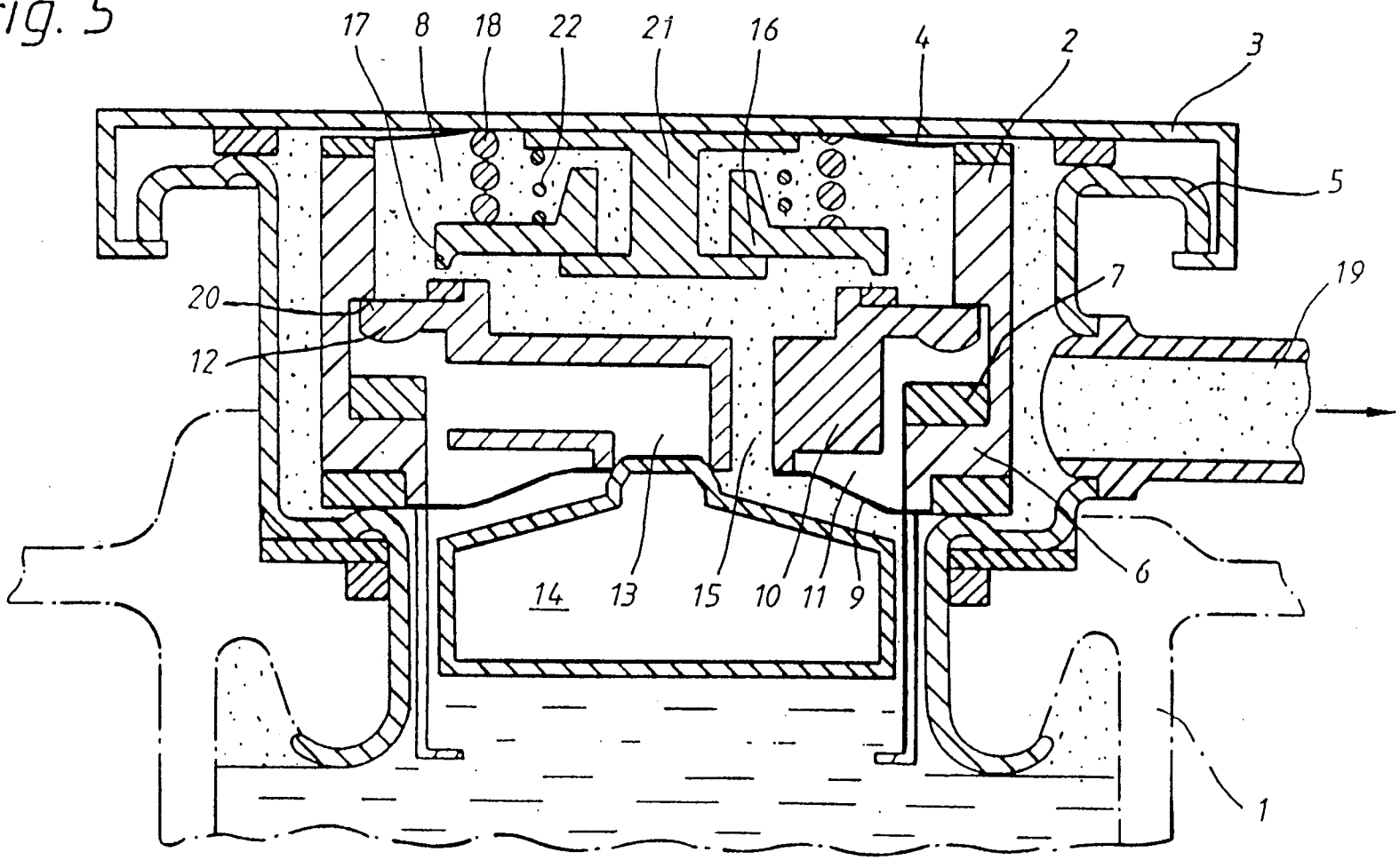
FIG. 5 is a view similar to FIG. 1 but showing the valve condition as shown in FIG. 4 but in which the high-pressure closing body is open.

In the operating condition shown in FIG. 4, the low-pressure closing body 10 is located in its position in which, because of its contact with the stop 20, makes possible an opening of the high-pressure closing body 16. Also present in the high-pressure closing body 16 is a non-return valve 21 opening towards the inside of the container. This non-return valve 21 has its own spring 22. By way of this non-return valve 21, pressure balance from the atmosphere to the inside of the container can take place in the case of a vacuum in the container.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A pressure-controlled valve device with an opening pressure switchable to a low pressure and to a high pressure in an internal combustion engine cooling fluid circuit and adapted to be arranged inside a cooling fluid container so as to be subjected to pressure, depending on an operating condition of an engine, by one of an emergent from cooling fluid and by the cooling fluid itself, comprising a float which can be raised with an increasing cooling fluid level so that the device opens at a higher pressure when subjected to fluid pressure than when subjected to emergent pressure and two spring-loaded moving closing bodies, wherein one of the bodies is configured as a low-pressure closing body arranged to determine a function when the device is subjected to emergent and is the support for the other of the bodies which is a high-pressure closing body, whereby when the float is raised, a flow path having flow controlled by the low-pressure closing body is shut off and a flow path leading through the low-pressure closing body to the high-pressure closing body is open, a closing pressure to which the closing bodies are subjected is introduced exclusively via the high-pressure closing body, a resultant effective area determining opening of the low-pressure closing body taking place under the control pressure is, under all operating conditions, greater than that for opening of the high-pressure closing body, and when the high-pressure closing body is open, the low-pressure closing body has a defined open position.

2. The pressure-controlled valve device according to claim 1 wherein the low-pressure closing body has an annular peripheral sealing flange protruding radially outwards for seating so as to seal against the valve outlet flow direction on a valve seat permanently attached within the valve housing and connected radially outwards in a gas-tight manner to the valve housing via a sealing element substantially free of reaction forces, the low-pressure flow path emerging into the cooling fluid casing existing between the diaphragm and the sealing flange, which low-pressure flow path being tightly separated from the inside of the cooling fluid casing when the float is raised, and the low-pressure closing body having the high-pressure flow path connecting the cooling fluid container to atmosphere when the high-pressure closing body is open.

3. The pressure-controlled valve device according to claim 1, wherein the high-pressure closing body is provided with a non-return valve opening from atmosphere to the inside of the cooling fluid container.

4. The pressure-controlled valve device according to claim 3, wherein the low-pressure closing body has an annular peripheral sealing flange protruding radially outwards for seating so as to seal against the valve outlet flow direction on a valve seat permanently attached within the valve housing and connected radially outwards in a gas-tight manner to the valve housing via a sealing element substantially free of reaction forces, the low-pressure flow path emerging into the cooling fluid casing existing between the diaphragm and the sealing flange, which low-pressure flow path being tightly separated from the inside of the cooling fluid casing when the float is raised, and the low-pressure closing body having the high-pressure flow path connecting the cooling fluid container to atmosphere when the high-pressure closing body is open.

* * * * *